US008798276B2

(12) United States Patent
Moon et al.

(10) Patent No.: US 8,798,276 B2
(45) Date of Patent: Aug. 5, 2014

(54) METHOD AND APPARATUS FOR ENCODING MULTI-CHANNEL AUDIO SIGNAL AND METHOD AND APPARATUS FOR DECODING MULTI-CHANNEL AUDIO SIGNAL

(75) Inventors: Han-gil Moon, Seoul (KR); Chul-woo Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 972 days.

(21) Appl. No.: 12/761,070

(22) Filed: Apr. 15, 2010

(65) Prior Publication Data

US 2011/0046964 A1 Feb. 24, 2011

(30) Foreign Application Priority Data

Aug. 18, 2009 (KR) ..... 10-2009-0076338

(51) Int. Cl.

| | |
|---|---|
| ***H04S 3/02*** | (2006.01) |
| ***G10L 19/008*** | (2013.01) |
| ***H04S 5/02*** | (2006.01) |
| ***H04S 3/00*** | (2006.01) |

(52) U.S. Cl.

USPC ..... 381/22; 381/23; 381/17; 381/18; 381/19; 700/94

(58) Field of Classification Search

USPC ..... 381/2, 17–19, 300, 303, 22–23; 704/219, 230, 500; 700/94

See application file for complete search history.

(56) References Cited

U.S. PATENT DOCUMENTS

| | | | | |
|---|---|---|---|---|
| 2006/0233379 | A1 * | 10/2006 | Villemoes et al. | 381/23 |
| 2008/0002842 | A1 * | 1/2008 | Neusinger et al. | 381/119 |
| 2008/0262850 | A1 | 10/2008 | Taleb et al. | |

FOREIGN PATENT DOCUMENTS

| | | | |
|---|---|---|---|
| CN | 101223598 | A | 7/2008 |
| KR | 10-2007-0011136 | A | 1/2007 |
| KR | 10-2009-0040857 | A | 4/2009 |
| WO | 2007/011157 | A1 | 1/2007 |
| WO | 2009/038512 | A1 | 3/2009 |
| WO | 2009/054665 | A1 | 4/2009 |
| WO | 2009084920 | A1 | 7/2009 |

OTHER PUBLICATIONS

Breebaart, et al., "MPEG Spatial Audio Coding / MPEG Surround: Overview and Current Status" In: Proc. 119th AES Convention, New York, NY, Oct. 2005, total 17 pages, Audio Engineering Society.

International Search Report (PCT/ISA/210) dated Apr. 12, 2011 in a counterpart international application No. PCT/KR2010/005449.

Communication dated Jan. 21, 2013, issued by the State Intellectual Property Office of People's Republic China in counterpart Chinese Patent Application No. 201080037106.9.

(Continued)

*Primary Examiner* — Duc Nguyen
*Assistant Examiner* — George Monikang
(74) *Attorney, Agent, or Firm* — Sughrue Mion, PLLC

(57) ABSTRACT

A method and apparatus which encode multi-channel audio signals and a method and apparatus which decode multi-channel audio signals. When encoding, a downmixed audio signal, first additional information for restoring multi-channel audio signals from the downmixed audio signal, and second additional information representing characteristics of a residual signal are multiplexed. When decoding, restored multi-channel audio signals having a predetermined phase difference are combined using the second additional information, and an audio signal of each channel is corrected, in order to improve quality of the restored audio signals.

46 Claims, 8 Drawing Sheets

(56) References Cited

OTHER PUBLICATIONS

Communication dated Oct. 2, 2013, issued by the European Patent Office in counterpart European Application No. 10810153.6.

Communication dated Aug. 21, 2013, issued by the Patent Office of the P.R.C. in counterpart Chinese Application No. 201080037106.9.

* cited by examiner

METHOD AND APPARATUS FOR ENCODING MULTI-CHANNEL AUDIO SIGNAL AND METHOD AND APPARATUS FOR DECODING MULTI-CHANNEL AUDIO SIGNAL

CROSS-REFERENCE TO RELATED PATENT APPLICATION

This application claims priority from Korean Patent Application No. 10-2009-0076338, filed on Aug. 18, 2009 in the Korean Intellectual Property Office, the disclosure of which is incorporated herein in its entirety by reference.

BACKGROUND

1. Field

Aspects of the present general inventive concept relate to encoding and decoding multi-channel audio signals, and more particularly, to a method and apparatus which encode multi-channel audio signals, in which a residual signal that may improve sound quality of each channel when restoring the multi-channel audio signals is used as predetermined parametric information, and a method and apparatus which decode the encoded multi-channel audio signals by using the encoded residual signal.

2. Description of the Related Art

In general, methods of encoding multi-channel audio signals can be roughly classified into waveform audio coding and parametric audio coding. Examples of waveform encoding include moving picture experts group (MPEG)-2 multi-channel (MC) audio coding, Advanced Audio Coding (AAC) MC audio coding, Bit-Sliced Arithmetic Coding (BSAC)/Audio Video Standard (AVS) MC audio coding, and the like.

In parametric audio coding, an audio signal is divided into frequency components and amplitude components in a frequency domain, and information about such frequency and amplitude components are parameterized in order to encode the audio signal by using such parameters. For example, when a stereo-audio signal is encoded using parametric audio coding, a left-channel audio signal and a right-channel audio signal of the stereo-audio signal are downmixed to generate a mono-audio signal, and then the mono-audio signal is encoded. In addition, parameters, such as an interchannel intensity difference (IID), an interchannel correlation (ID), an overall phase difference (OPD), and an interchannel phase difference (IPD), are encoded for each frequency band. Herein, the IID and ID parameters are used to determine the intensities of left-channel and right-channel audio signals of stereo-audio signals when decoding. In addition, the OPD and IPD parameters are used to determine the phases of the left-channel and right-channel audio signals of the stereo-audio signals when decoding.

In such parametric audio coding, an audio signal decoded after being encoded may differ from an initial input audio signal. In general, such a difference value between the audio signal restored after being encoded and the input audio signal is defined as a residual signal. Such a residual signal represents a sort of encoding error. In order to improve sound quality of each channel when decoding an audio signal, the residual signal has to be decoded for use when decoding the audio signal.

SUMMARY

Aspects of the present general inventive concept provide a method and apparatus which encode multi-channel audio signals in which residual signal information about a difference value between a multi-channel audio signal decoded after being encoded and an input multi-channel audio signal is efficiently encoded, thereby minimizing the residual signal. Aspects of the present general inventive concept also provide a method and apparatus which decode multi-channel audio signals by using the encoded residual signal information in order to improve sound quality of each channel.

According to an aspect of the present inventive concept, there is provided a method of encoding multi-channel audio signals, the method comprising: performing parametric encoding on input multi-channel audio signals to generate a downmixed audio signal and first additional information; restoring the multi-channel audio signals from the downmixed audio signal using the downmixed audio signal and the first additional information; generating a residual signal corresponding to a difference value between each of the input multi-channel audio signals and the corresponding restored multi-channel audio signal; generating second additional information representing characteristics of the residual signal; and multiplexing the downmixed audio signal, the first additional information, and the second additional information.

According to another aspect of the present inventive concept, there is provided an apparatus for encoding multi-channel audio signals, the apparatus comprising: a multi-channel encoding unit which performs parametric encoding on input multi-channel audio signals to generate a downmixed audio signal and first additional information used to restore the multi-channel audio signals from the downmixed audio signal; a residual signal generating unit which restores the multi-channel audio signals from the downmixed audio signal using the downmixed audio signal and the first additional information, and which generates a residual signal corresponding to a difference value between each of the input multi-channel audio signals and the corresponding restored multi-channel audio signal; a residual signal encoding unit which generates second additional information representing characteristics of the residual signal; and a multiplexing unit which multiplexes the downmixed audio signal, the first additional information, and the second additional information.

According to another aspect of the present inventive concept, there is provided a method of decoding multi-channel audio signals, the method comprising: extracting, from encoded audio data, a downmixed audio signal, first additional information used to restore multi-channel audio signals from the downmixed audio signal, and second additional information representing characteristics of a residual signal, which corresponds to a difference value between each of input multi-channel audio signals before encoding and the corresponding restored multi-channel audio signal after the encoding; restoring a first multi-channel audio signal by using the downmixed audio signal and the first additional information; generating a second multi-channel audio signal having a predetermined phase difference with respect to the restored first multi-channel audio signal by using the downmixed audio signal and the first additional information; and generating a final restored audio signal by combining the restored first multi-channel audio signal and the generated second multi-channel audio signal by using the second additional information.

According to another aspect of the present inventive concept, there is provided an apparatus for decoding multi-channel audio signals, the apparatus comprising: a demultiplxing unit which extracts, from encoded audio data, a downmixed audio signal, first additional information used to restore multi-channel audio signals from the downmixed audio signal, and second additional information representing characteristics of a residual signal, which corresponds to a difference value between each of input multi-channel audio signals before encoding and the corresponding restored multi-channel audio signal after the encoding; a multi-channel decoding unit which restores a first multi-channel audio signal by using the downmixed audio signal and the first additional information; a phase shifting unit which generates a second multi-channel audio signal having a predetermined phase difference with respect to the restored first multi-channel audio signal by using the downmixed audio signal and the first additional information; and a combining unit that combines the restored first multi-channel audio signal and the generated second multi-channel audio signal by using the second additional information to generate a final restored audio signal.

According to yet another aspect of the present inventive concept, there is provided a method of encoding multi-channel audio signals, the method comprising: performing parametric encoding on input multi-channel audio signals to generate a downmixed audio signal; restoring the multi-channel audio signals from the downmixed audio signal; generating a residual signal corresponding to a difference value between each of the input multi-channel audio signals and the corresponding restored multi-channel audio signal; generating additional information representing characteristics of the residual signal; and multiplexing the downmixed audio signal and the additional information.

According to still another aspect of the present inventive concept, there is provided a method of generating final restored multi-channel audio signals from a downmixed audio signal, the method comprising: extracting, from encoded audio data, the downmixed audio signal and additional information representing characteristics of a residual signal, which corresponds to a difference value between each of input multi-channel audio signals before encoding to the downmixed audio signal and the corresponding restored multi-channel audio signal after the encoding; restoring the multi-channel audio signals from the downmixed audio signal; and generating the final restored multi-channel audio signals from the corresponding restored multi-channel audio signals by using the additional information.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Aspects of the present general inventive concept will now be described more fully with reference to the accompanying drawings, in which exemplary embodiments of the invention are shown.

Figure 1:
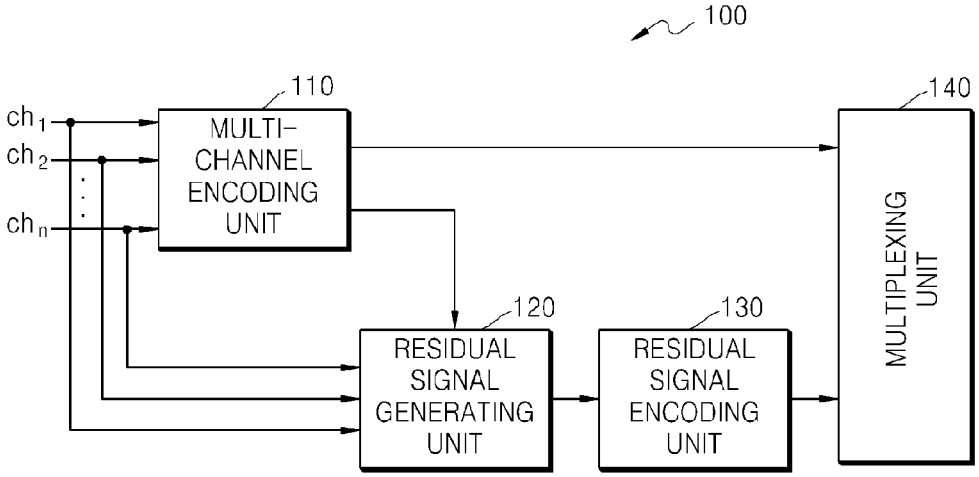
FIG. 1 is a block diagram of an apparatus which encodes multi-channel audio signals, according to an exemplary embodiment of the present inventive concept.

FIG. 1 is a block diagram of an apparatus 100 which encodes multi-channel audio signals, according to an exemplary embodiment of the present inventive concept. Referring to FIG. 1, the apparatus 100 which encodes multi-channel audio signals includes a multi-channel encoding unit 110, a residual signal generating unit 120, a residual signal encoding unit 130 and a multiplexing unit 140. If input multi-channel audio signals Ch1 through Chn (where n is a positive integer) are not digital signals, the apparatus 100 may further include an analog-to-digital converter (ADC, not shown) that samples and quantizes the n input multi-channel signals to convert the n input multi-channel signals into digital signals.

The multi-channel encoding unit 110 performs parametric encoding on the n input multi-channel audio signals to generate downmixed audio signals and first additional information for restoring the multi-channel audio signals from the downmixed audio signals. In particular, the multi-channel encoding unit 110 downmixes the n input multi-channel audio signals into a number of audio signals less than n, and generates the first additional information for restoring the n multi-channel audio signals from the downmixed audio signals. For example, if the input signals are 5.1-channel audio signals, i.e., if six multi-channel audio signals of a left (L) channel, a surround left (Ls) channel, a center (C) channel, a subwoofer (Sw) channel, a right (R) channel and a surround right (Rs) channel are input to the multi-channel encoding unit 110, the multi-channel encoding unit 110 downmixes the 5.1-channel audio signals into two-channel stereo signals of the L and R channels and encodes the two-channels stereo signals to generate an audio bitstream. In addition, the multi-channel encoding unit 110 generates the first additional information for restoring the 5.1-channel audio signals from the two-channel stereo signals. The first additional information may include information for determining intensities of the audio signals to be downmixed and information about phase differences between the audio signals to be downmixed. Hereinafter, a downmixing process and a process of generating the first additional information that are performed by the multi-channel encoding unit 110 will be described in greater detail.

Figure 2:
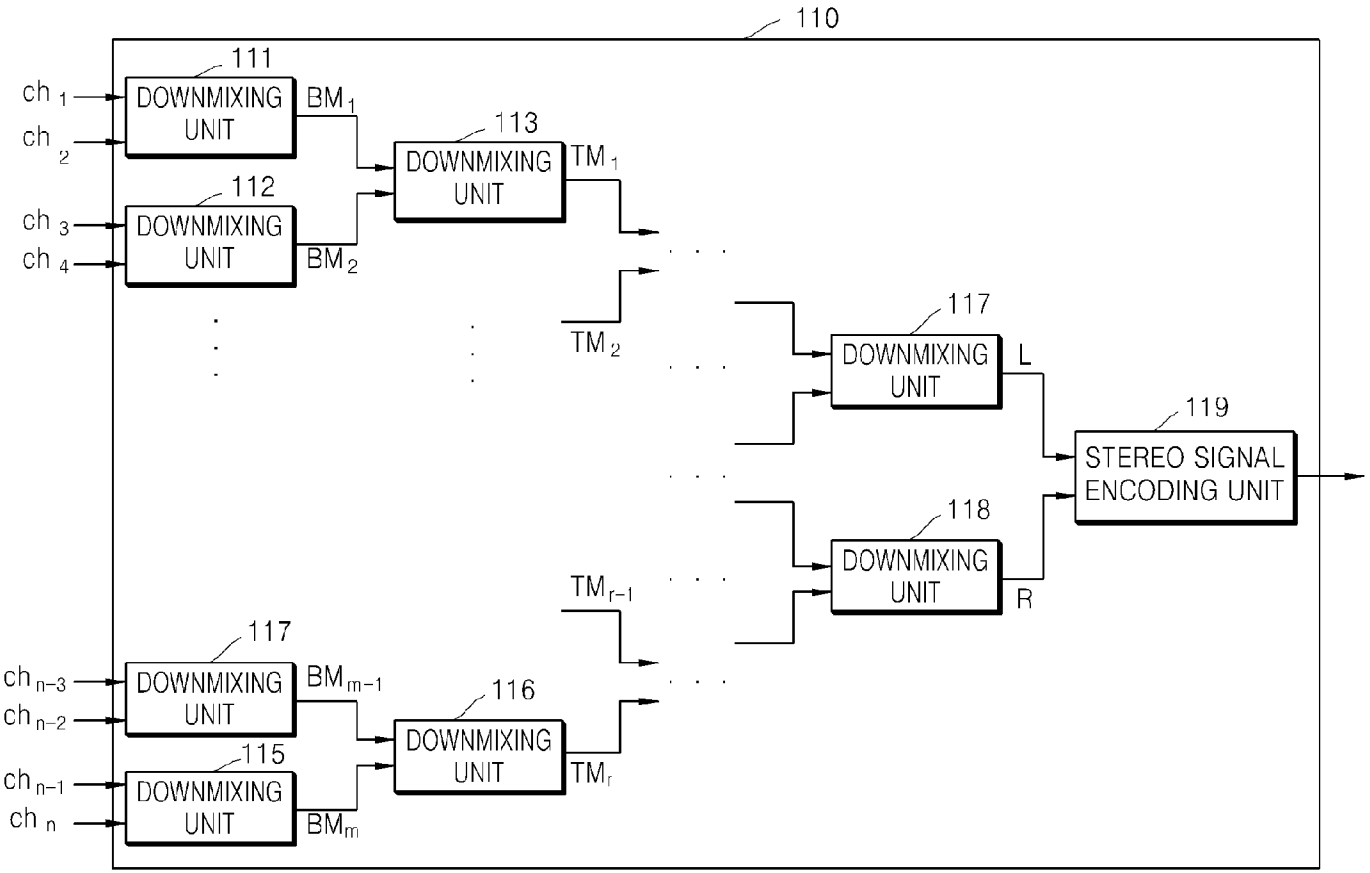
FIG. 2 is a block diagram of a multi-channel encoding unit 110 of FIG. 1, according to an exemplary embodiment of the present inventive concept.

FIG. 2 is a block diagram of the multi-channel encoding unit 110 of FIG. 1, according to an exemplary embodiment of the present inventive concept. Referring to FIG. 2, the multi-channel encoding unit 110 includes a plurality of downmixing units 111 through 118 and a stereo signal encoding unit 119.

The multi-channel encoding unit 110 receives the n input multi-channel audio signals $Ch_1$ through $Ch_n$, and combines each pair of the n input multi-channel audio signals to generate downmixed output signals. The multi-channel encoding unit 110 repeatedly performs this downmixing on each pair of the downmixed output signals to output the downmixed audio signals. For example, the downmixing unit 111 combines a first channel input audio signal $Ch_1$ and a second channel input audio signal $Ch_2$ to generate a downmixed output signal $BM_1$. Similarly, the downmixing unit 112 combines a third channel input audio signal $Ch_3$ and a fourth channel input audio signal $Ch_4$ to generate a downmixed output signal $BM_2$. The two downmixed output signals $BM_1$ and $BM_2$ output from the two downmixing units 111 and 112 are downmixed by the downmixing unit 113 and output as a downmixed output signal $TM_1$. Such downmixing processes may be repeated until two-channel stereo-audio signals of L and R channels are generated, as illustrated in FIG. 2, or until a downmixed mono-audio signal obtained by further downmixing the two-channels stereo-audio signals of the L and R channels is output.

The stereo signal encoding unit 119 encodes the downmixed stereo-audio signals output from the downmixing units 111 through 118 to generate an audio bitstream. The stereo signal encoding unit 119 may use a general audio codec such as MPEG Audio Layer 3 (MP3) or Advanced Audio Codec (AAC).

The downmixing units 111 through 118 may set phases of two audio signals to be the same as each other when combining the two audio signals. For example, when combining the first channel input audio signal $Ch_1$ and the second channel input audio signal $Ch_2$, the downmixing unit 111 may set a phase of the second channel input audio signal $Ch_2$ to be the same as a phase of the first channel input audio signal $Ch_1$ and then add the phase-adjusted second channel audio signal $Ch_2$ and the first channel input audio signal $Ch_1$ so as to downmix the first channel input audio signal $Ch_1$ and the second channel input audio signal $Ch_2$. This will be described in detail later.

In addition, the downmixing units 111 through 118 may generate the first additional information used to restore, for example, two audio signals from each of the downmixed output signals, when the downmixed output signals are generated by downmixing each pair of the audio signals. As described above, the first additional information may include information for determining intensities of audio signals to be downmixed and information about phase differences between the audio signals to be downmixed. When a conventional apparatus which downnmixes stereo-audio signals to mono-audio signals is used as the downmixing units 111 through 118, parameters, such as an interchannel intensity difference (ILD), an interchannel correlation (ID), an overall phase difference (OPD) and an interchannel phase difference (IPD), may be encoded with respect to each of the downmixed output signals. In this case, the ILD and ID parameters may be used to determine intensities of the two original input audio signals to be downmixed from the corresponding downmixed output signal. In addition, the OPD and IPD parameters may be used to determine the phases of the two original input audio signals to be downmixed from the downmixed output signal.

In particular, the downmixing units 111 through 118 may generate the first additional information, which includes the information for determining the intensities and phases of the two input audio signals to be downmixed, based on a relationship of the two input audio signals and the downmixed signal in a predetermined vector space, which will be described in detail later.

Hereinafter, a method of generating the first additional information performed by the multi-channel encoding unit 110 of FIG. 2 will be described with reference to FIGS. 3A and 3B. For convenience of explanation, a method of generating the first additional information will be described with reference to when the downmixing unit 111, selected from among the plurality of downmixing units 111 through 118, generates the downmixed output signal BM1 from the received first channel input audio signal $Ch_1$ and second channel input audio signal $Ch_2$. The process of generating the first additional information performed by the downmixing unit 111 may be applied to the other downmixing units 112 through 118 of the multi-channel encoding unit 110. Hereinafter, a method of generating information for determining intensities of the first channel input audio signal $Ch_1$ and the second channel input audio signal $Ch_2$ and a method of generating information for determining phases of the first channel input audio signal $Ch_1$ and the second channel input audio signal $Ch_2$ will be separately described.

(1) Information for Determining Intensities of Input Audio Signals

In parametric audio coding, multi-channel audio signals are transformed to the frequency domain, and information about the intensity and phase of each of the multi-channel audio signals are encoded in the frequency domain. When an audio signal is transformed by Fast Fourier Transformation, the audio signal may be represented by discrete values in the frequency domain. That is, the audio signal may be represented as a sum of multiple sine waves. In parametric audio coding, when an audio signal is transformed to the frequency domain, the frequency domain is divided into a plurality of subbands, and information for determining the intensities of the first channel input audio signal $Ch_1$ and the second channel input audio signal $Ch_2$ and information for determining the phases of the first channel input audio signal $Ch_1$ and the second channel input audio signal $Ch_2$ are encoded with respect to each of the subbands. In particular, after additional information about intensities and phases of the first channel input audio signal $Ch_1$ and the second channel input audio signal $Ch_2$ in a subband k is encoded, additional information about intensities and phases of the first channel input audio signal $Ch_1$ and the second channel input audio signal $Ch_2$ in a subband k+1 is encoded. In parametric audio coding, the entire frequency band is divided into a plurality of subbands in the manner described above, and additional information about stereo-audio signals is encoded with respect to each of the subbands.

Hereinafter, with regard to encoding and decoding stereo-audio signals of N channels, a process of encoding additional information about the first channel input audio signal $Ch_1$ and the second channel input audio signal $Ch_2$ in a predetermined frequency band, i.e., in a subband k, will be described as an example.

In conventional parametric audio coding, when additional information about stereo-audio signals is encoded, information about an interchannel intensity difference (IID) and an interchannel correlation (IC) is encoded as information for determining the intensities of the first channel input audio signal $Ch_1$ and the second channel input audio signal $Ch_2$ in the subband k, as described above. In particular, the intensities of the first channel input audio signal $Ch_1$ and the second channel input audio signal $Ch_2$ in the subband k are separately calculated, and a ratio between the intensities of the first channel input audio signal $Ch_1$ and the second channel input audio signal $Ch_2$ is encoded as information about the IID. However, the intensities of the first channel input audio signal $Ch_1$ and the second channel input audio signal $Ch_2$ cannot be determined on a decoding side by using only the ratio between the intensities of the first and second channel audio signals $Ch_1$ and $Ch_2$. Thus, the information about the IC is encoded together with IID and inserted into a bitstream as additional information.

In a method of encoding multi-channel audio signals according to an exemplary embodiment of the present inventive concept, in order to minimize the number of additional information to be encoded as information for determining the intensities of the first channel input audio signal $Ch_1$ and the second channel input audio signal $Ch_2$ in the subband k, respective vectors representing the intensities of the first channel input audio signal $Ch_1$ and the second channel input audio signal $Ch_2$ in the subband k are used. Herein, an average of the intensities of the first channel input audio signal $Ch_1$ at frequencies f1, f2, . . . , fn in the frequency spectra of the transformed frequency domain corresponds to the intensity of the first channel input audio signal $Ch_1$ in the subband k, and also corresponds to a magnitude of a vector $\overrightarrow{Ch_1}$, which will be described later with reference to FIGS. 3A and 3B.

Likewise, an average of the intensities of the second channel input audio signal $Ch_2$ at frequencies f1, f2, . . . , fn in the frequency spectra of the transformed frequency domain corresponds to the intensity of the second channel input audio signal $Ch_2$ in the subband k, and also corresponds to a magnitude of a vector $\overrightarrow{Ch_2}$, which will be described in detail below with reference to FIGS. 3A and 3B.

Figure 3A:
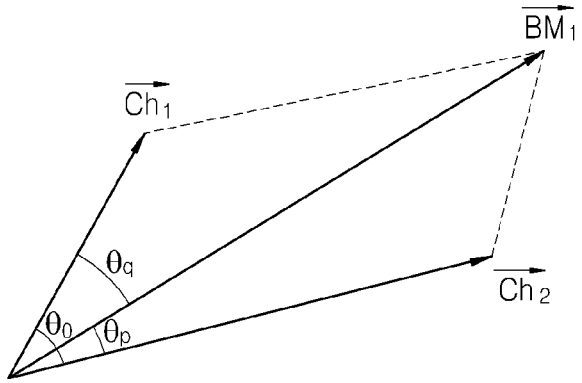
FIG. 3A is a diagram for describing a method of generating information about intensities of a first channel input audio signal and a second channel input audio signal, according to an exemplary embodiment of the present inventive concept.

FIG. 3A is a diagram for describing a method of generating information about intensities of a first channel input audio signal and a second channel input audio signal, according to an exemplary embodiment of the present inventive concept. Referring to FIG. 3A, the downmixing unit 111 creates a 2-dimensional vector space (such as for the vector $\overrightarrow{Ch_1}$ and the vector $\overrightarrow{Ch_2}$) to form a predetermined angle, wherein the vector $\overrightarrow{Ch_1}$ and the vector $\overrightarrow{Ch_2}$ respectively correspond to the intensities of the first channel input audio signal $Ch_1$ and the second channel input audio signal $Ch_2$ in the subband k. If the first channel input audio signal $Ch_1$ and the second channel input audio signal $Ch_2$ are left-channel and right-channel audio signals, respectively, the stereo-audio signals are encoded, in general, with the assumption that a user listens to the stereo-audio signals at a location where a direction of a left sound source and a direction of a right sound source form an angle of 60 degrees. Thus, an angle $\theta_0$ between the vectors $\overrightarrow{Ch_1}$ and $\overrightarrow{Ch_2}$ may be set to 60 degrees in the 2-dimensional vector space, though it is understood that aspects of the present inventive concept are not limited thereto. For example, in other embodiments, the angle $\theta_0$ between the vectors $\overrightarrow{Ch_1}$ and $\overrightarrow{Ch_2}$ may have an arbitrary value.

In FIG. 3A, a vector $\overrightarrow{BM_1}$ corresponding to the intensity of an output signal $BM_1$ that is a sum of the vectors $\overrightarrow{Ch_1}$ and $\overrightarrow{Ch_2}$ is shown. In this case, if the first channel input audio signal $Ch_1$ and the second channel input audio signal $Ch_2$ are left-channel and right-channel audio signals, respectively, as described above, the user may listen to a mono-audio signal having an intensity that corresponds to the magnitude of the vector $\overrightarrow{BM_1}$ at the location where the direction of the left sound source and the direction of the right sound source form an angle of 60 degrees.

The downmixing unit 111 may generate information about an angle θq between the vector $\overrightarrow{BM_1}$ and the vector $\overrightarrow{Ch_1}$ or information about an angle θp between the vector $\overrightarrow{BM_1}$ and the vector $\overrightarrow{Ch_2}$, instead of information about an IID and information about an IC, as the information for determining the intensities of the first channel input audio signal $Ch_1$ and the second channel input audio signal $Ch_2$ in the subband k. Alternatively, the downmixing unit 111 may generate a cosine value (cos θq) of the angle θq between the vector $\overrightarrow{BM_1}$ and the vector $\overrightarrow{Ch_1}$, or a cosine value (cos θp) of the angle θp between the vector $\overrightarrow{BM_1}$ the vector $\overrightarrow{Ch_2}$, instead of just the angle θq or θp. This is for minimizing a loss in quantization when the information about the angle θq or θp is encoded. Thus, a value of a trigonometric function, such as a cosine value or a sine value, may be used to generate information about the angle θq or θp.

Figure 3B:
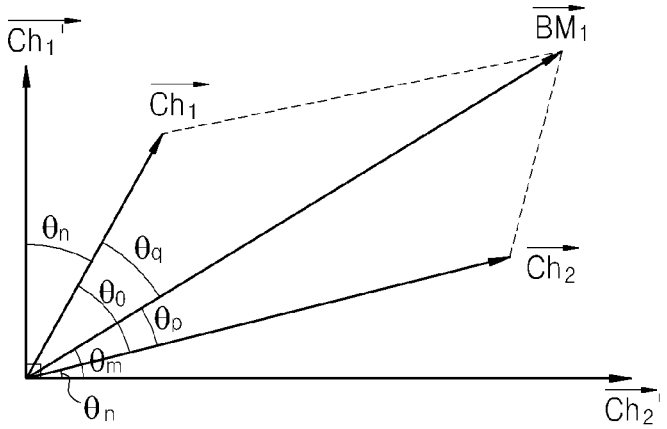
FIG. 3B is a diagram for describing a method of generating information about intensities of a first channel input audio signal and a second channel input audio signal, according to another exemplary embodiment of the present inventive concept.

FIG. 3B is a diagram for describing a method of generating information about intensities of a first channel input audio signal and a second channel input audio signal, according to another exemplary embodiment of the present inventive concept. In particular, FIG. 3B is a diagram for describing normalizing a vector angle illustrated in FIG. 3A.

As illustrated in FIG. 3A, when the angle $\theta_0$ between the vector $\overrightarrow{Ch_1}$, and the vector $\overrightarrow{Ch_2}$ is not equal to 90 degrees, the angle $\theta_0$ may be normalized to 90 degrees. Thus, the angle θp or the angle θq may be normalized.

Referring to FIG. 3B, when information about the angle θp between the vector BM1 and the vector $\overrightarrow{Ch_2}$ is normalized, i.e., when the angle $\theta_0$ is normalized to 90 degrees, the angle θp is consequently normalized to $\theta m=(\theta_p\times 90)/\theta_0$. The downmixing unit 111 may generate the unnormalized angle θp or the normalized angle θm as the information for determining the intensities of the first channel input audio signal $Ch_1$ and the second channel input audio signal $Ch_2$. Alternatively, the downmixing unit 111 may generate a cosine value (cos θp) of the angle θp or a cosine value (cos θm) of the normalized angle θm, instead of just the unnormalized angle θp or the normalized angle θm, as the information for determining the intensities of the first channel input audio signal $Ch_1$ and the second channel input audio signal $Ch_2$.

(2) Information for Determining Phases of Input Audio Signals

In conventional parametric audio coding, information about an overall phase difference (OPD) and information about an interchannel phase difference (IPD) are encoded as information for determining the phases of the first channel input audio signal $Ch_1$ and the second channel input audio signal $Ch_2$ in the subband k, as described above. In other words, conventionally, information about the OPD is generated by calculating a phase difference between a first mono-audio signal $BM_1$, which is generated by combining the first channel input audio signal $Ch_1$ and the second channel input audio signal $Ch_2$ in the subband k, and the first channel input audio signal $Ch_1$ in the subband k. In addition, information about IPD is generated by calculating a phase difference between the first channel input audio signal $Ch_1$ and the second channel input audio signal $Ch_2$ in the subband k. Such a phase difference may be calculated as an average of phase differences respectively calculated at frequencies f1, f2, . . . , fn included in the subband k.

According to aspects of the present inventive concept, the downmixing unit 111 may exclusively generate information about a phase difference between the first channel input audio signal $Ch_1$ and the second channel input audio signal $Ch_2$ in the subband k, as the information for determining the phases of the first channel input audio signal $Ch_1$ and the second channel input audio signal $Ch_2$.

In the current exemplary embodiment of the present inventive concept, the downmixing unit 111 adjusts the phase of the second channel input audio signal $Ch_2$ to be the same as the phase of the first channel input audio signal $Ch_1$, and combines the phase-adjusted second channel input audio signal $Ch_2$ and the first channel input audio signal $Ch_1$. Thus, the phases of the first channel input audio signal $Ch_1$ and the second channel input audio signal $Ch_2$ may be calculated only with the information about the phase difference between the first channel input audio signal $Ch_1$ and the second channel input audio signal $Ch_2$.

For example, for audio signals in the subband k, the phases of the second channel input audio signal $Ch_2$ at frequencies f1, f2, . . . , fn included in subband k are separately adjusted to be the same as the phases of the first channel input audio Ch2 at frequencies f1, f2, . . . , fn, respectively. For example, when the phase of the first channel input audio signal $Ch_1$ at frequency f1 is adjusted, if the first channel input audio signal $Ch_1$ and the second channel input audio signal $Ch_2$ at frequency f1 are represented as $|Ch_1|e^{i(2\pi flt+\theta 1)}$ and $|Ch_2|e^{i(2\pi flt+\theta 2)}$, respectively, a second channel input audio signal $Ch_2'$ whose phase at frequency f1 has been adjusted is represented as $|Ch_2|e^{i(2\pi flt+\theta 1)}$, where θ1 denotes the phase of the first channel input audio signal $Ch_1$ at frequency f1, and θ2 denotes the phase of the second channel input audio signal $Ch_2$ at frequency f1. Such a phase adjustment is repeatedly performed on the second channel input audio signal $Ch_2$ at the other frequencies f2, f3, . . . , fn included in the subband k to generate the phase-adjusted second channel input audio signal $Ch_2$ in the subband k.

The phase-adjusted second channel input audio signal $Ch_2$ in the subband k has the same phase as the phase of the first channel input audio signal $Ch_1$, and thus, the phase of the second channel input audio signal $Ch_2$ may be calculated on a decoding side, provided that a phase difference between the first channel input audio signal $Ch_1$ and the second channel input audio signal $Ch_2$ is encoded. In addition, since the phase of the first channel input audio signal $Ch_1$ is the same as the phase of the output signal $BM_1$ generated by the downmixing unit 111, it is unnecessary to separately encode information about the phase of the first channel input audio signal $Ch_1$.

Thus, provided that information about the phase difference between the first channel input audio signal $Ch_1$ and the second channel input audio signal $Ch_2$ is encoded, the phases of the first channel input audio signal $Ch_1$ and the second channel input audio signal $Ch_2$ may be calculated using only the encoded information about the phase difference on a decoding side.

Meanwhile, the method of encoding the information for determining the intensities of the first channel input audio signal $Ch_1$ and the second channel input audio signal $Ch_2$ by using vectors representing the intensities of the first channel input audio signal $Ch_1$ and the second channel input audio signal $Ch_2$ in the subband k (as described above with reference to FIGS. 3A and 3B), and the method of encoding the information for determining the phases of the first channel input audio signal $Ch_1$ and the second channel input audio signal $Ch_2$ through phase adjusting may be used separately or in combination. For example, the information for determining the intensities of the first channel input audio signal $Ch_1$ and the second channel input audio signal $Ch_2$ may be encoded using vectors according to aspects of the present inventive concept, whereas the information for determining the phases of the first channel input audio signal $Ch_1$ and the second channel input audio signal $Ch_2$ may be encoded using the information about the OPD and the information about the IPD, as in the conventional art. In contrast, the information for determining the intensities of the first channel input audio signal $Ch_1$ and the second channel input audio signal $Ch_2$ may be encoded using the information about the IID and the information about the IC according to the conventional art, whereas the information for determining the phases of the first channel input audio signal $Ch_1$ and the second channel input audio signal $Ch_2$ may be exclusively encoded through phase adjusting according to aspects of the present inventive concept as described above.

The above-described process of generating the first additional information may also be equally applied when generating first additional information for restoring two input audio signals from the downmixed audio signal output from each of the downmixing units 111 through 118 illustrated in FIG. 2.

In addition, the multi-channel encoding unit 110 is not limited to the exemplary embodiment described above, and may be applied to any parametric encoding unit that encodes multi-channel audio signals to output downmixed audio signals, and generates additional information for restoring the multi-channel audio signals from the downmixed audio signals.

Referring back to FIG. 1, the downmixed audio signals and the first additional information generated by the multi-channel encoding unit 110 are input to the residual signal generating unit 120.

The residual signal generating unit 120 restores the multi-channel audio signals by using the downmixed audio signals and the first additional information, and generates a residual signal that is a difference value between each of the received multi-channel audio signals and the corresponding restored multi-channel audio signal.

Figure 4:
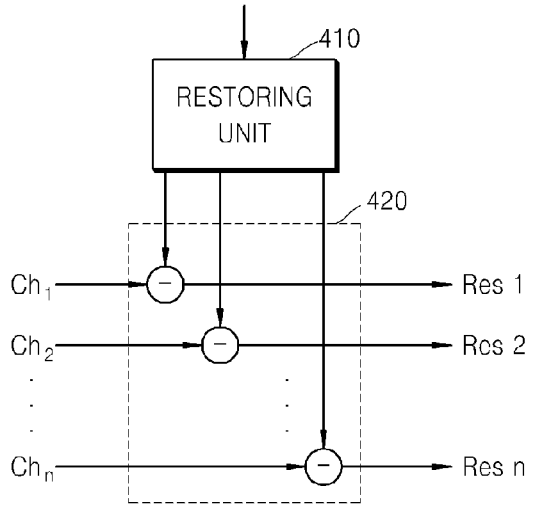
FIG. 4 is a block diagram of a residual signal generating unit of FIG. 1, according to an exemplary embodiment of the present inventive concept.

FIG. 4 is a block diagram of the residual signal generating unit 120 of FIG. 1, according to an exemplary embodiment of the present inventive concept. Referring to FIG. 4, the residual signal generating unit 120 includes a restoring unit 410 and a subtracting unit 420.

The restoring unit 410 restores the multi-channel audio signals by using the downmixed audio signals and the first additional information output from the multi-channel encoding unit 110. In particular, the restoring unit 410 generates two upmixed output signals from the downmixed audio signal by using the first additional information to repeatedly upmix each of the upmixed output signals in order to restore the multi-channel audio signals input to the multi-channel encoding unit 110.

The subtracting unit 420 calculates a difference value between each of the restored multi-channel audio signals and the corresponding input audio signals in order to generate residual signals Res1 through Resn for the respective channels.

Figure 5:
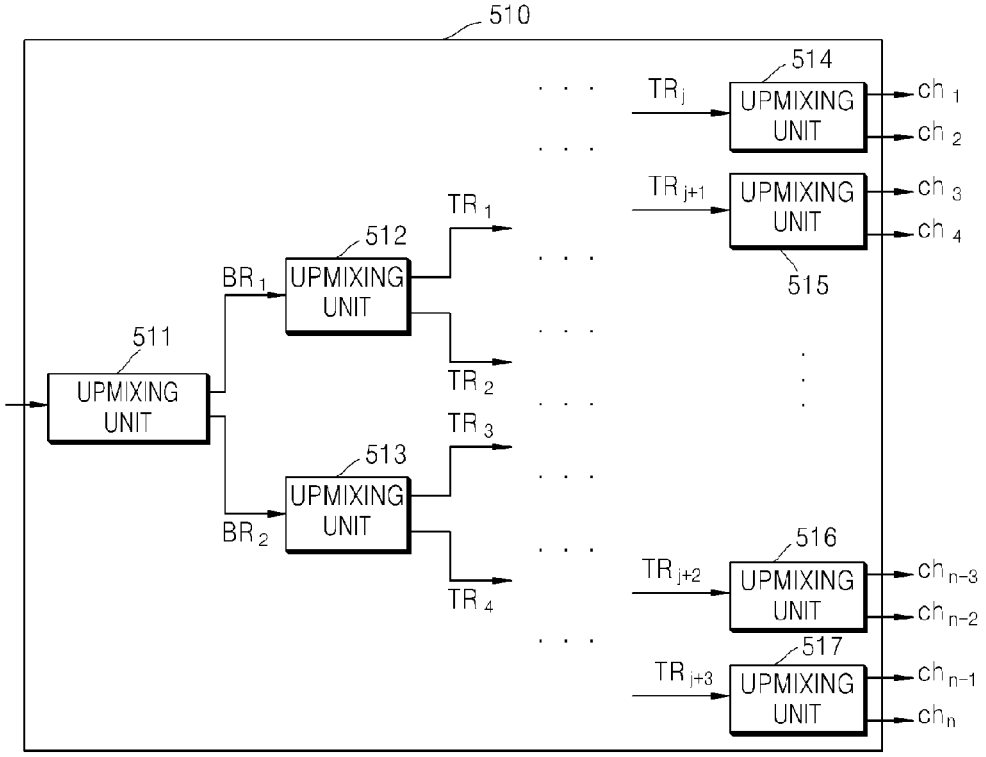
FIG. 5 is a block diagram of a restoring unit of FIG. 1, according to an exemplary embodiment of the present inventive concept.

FIG. 5 is a block diagram of a restoring unit 510 as an exemplary embodiment of the restoring unit 410 of FIG. 4. Referring to FIG. 5, the restoring unit 510 restores two audio signals from the downmixed audio signal by using the first additional information and repeatedly restores two audio signals from each of the restored two audio signals by using the corresponding first additional information to generate n restored multi-channel audio signals, where n is a positive integer equal to the number of input multi-channel audio signals. The restoring unit 510 includes a plurality of upmixing units 511 through 517. The upmixing units 511 through 517 upmix one downmixed audio signal by using the first additional information to restore two upmixed audio signals and repeatedly perform such upmixing on each of the upmixed audio signals until a number of multi-channel audio signals equal to the number of input multi-channel audio signals is restored.

The operations of the upmixing units 511 through 517 will now be described in detail. For convenience of explanation, the operation of the upmixing unit 514, as an example selected from among the upmixing units 511 through 517 illustrated in FIG. 5, will be described, wherein the upmixing unit 514 upmixes a downmixed audio signal $TR_j$ to output the first channel audio signal $Ch_1$ and the second channel audio signal $Ch_2$. The operation of the upmixing unit 514 may equally apply to the other upmixing units 511 through 513 and 515 through 517 illustrated in FIG. 5.

Referring to FIGS. 3A and 5, the upmixing unit 514 uses the information about the angle θq or the angle θp between the vector $\overrightarrow{BM_1}$ representing the intensity of the downmixed audio signal $TR_j$ and the vector $\overrightarrow{Ch_1}$ representing the intensity of the first channel input audio signal $Ch_1$ or the vector $\overrightarrow{Ch_2}$ representing the intensity of the second channel input audio signal $Ch_2$, to determine the intensities of the first channel input audio signal $Ch_1$ and the second channel input audio signal $Ch_2$ in the subband k. Alternatively (or additionally), information about a cosine value (cos θq) of the angle θq between the vector $\overrightarrow{BM_1}$ and the vector $\overrightarrow{Ch_1}$ or information about a cosine value (cos θp) of the angle θp between the vector $\overrightarrow{BM_1}$ and the vector $\overrightarrow{Ch_2}$ may be used.

Referring to FIGS. 3B and 5, if the angle $\theta_0$ between the vector $\overrightarrow{Ch_1}$ and the vector $\overrightarrow{Ch_2}$ is 60 degrees, the intensity of the first channel input audio signal $Ch_1$ (i.e., the magnitude of the vector $Ch_1$) may be calculated using the following equation: $|\overrightarrow{Ch_1}|=|\overrightarrow{BM_1}|*\sin\theta m/\cos(\pi r/12)$, where $|\overrightarrow{BM_1}|$ denotes the intensity of the downmixed audio signal ($TR_j$) (i.e., the magnitude of the vector BM1), and assuming that the angle between the vector $\overrightarrow{Ch_1}$ and the vector $\overrightarrow{Ch_1}'$ is 15 degrees (π/12). Likewise, if the angle $\theta_0$ between the vector $\overrightarrow{Ch_1}$ and the vector $Ch_2$ is 60 degrees, the intensity of the second channel input audio signal $Ch_2$ (i.e., the magnitude of the vector $\overrightarrow{Ch_2}$) may be calculated using the following equation: $|\overrightarrow{Ch_2}|=|\overrightarrow{BM_1}|*\cos\theta m/\cos(\pi/12)$, assuming that the angle between the vector $\overrightarrow{Ch_2}$ and the vector $\overrightarrow{Ch_2}'$ is 15 degrees (π/12).

The upmixing unit 514 may use information about a phase difference between the first channel input audio signal $Ch_1$ and the second channel input audio signal $Ch_2$ in the subband k to determine the phases of the first channel input audio signal $Ch_1$ and the second channel input audio signal $Ch_2$ in the subband k. If the phase of the second channel input audio signal $Ch_2$ is adjusted to be the same as the phase of the first channel input audio signal $Ch_1$ when encoding the downmixed audio signal $TR_j$ according to aspects of the present inventive concept, the upmixing unit 514 may calculate the phases of the first channel input audio signal $Ch_1$ and the second channel input audio signal $Ch_2$ by using only the information about the phase difference between the first channel input audio signal $Ch_1$ and the second channel input audio signal $Ch_2$.

Meanwhile, the method of decoding the information for determining the intensities of the first channel input audio signal $Ch_1$ and the second channel input audio signal $Ch_2$ in the subband k using vectors, and the method of decoding the information for determining the phases of the first channel input audio signal $Ch_1$ and the second channel input audio signal $Ch_2$ through phase adjusting, which are described above, may be used separately or in combination.

Referring back to FIG. 1, once the residual signal generating unit 120 has generated a residual signal corresponding to a difference value between each of the restored multi-channel audio signals and the corresponding input multi-channel audio signal, the residual signal encoding unit 130 generates second additional information representing characteristics of the residual signal. The second additional information corresponds to a sort of enhanced hierarchy information used to correct the multi-channel audio signals that have been restored using the downmixed audio signals and the first additional information on a decoding side, to be as equal to the characteristics of the input audio signals as possible. The second additional information may be used to correct the multi-channel audio signals restored on a decoding side, as will be described later.

The multiplexing unit 140 multiplexes the downmixed audio signal and the first additional information, which are output from the multi-channel encoding unit 110, and the second additional information, which is output from the residual signal encoding unit 130, to generate a multiplexed audio bitstream.

Hereinafter, a process of generating the second additional information performed by the residual signal encoding unit 130 will be described in greater detail. The second additional information may include an interchannel correlation (ICC) parameter representing a correlation between multi-channel audio signals of two different channels. In particular, assuming that N is a positive integer denoting the number of input multi-channels, denotes an ICC parameter representing a correlation between audio signals of an ith channel and a (i+1)th channel, where i is an integer from 1 to N−1, k denotes a sample index, $x_i(k)$ denotes a value of an input audio signal of the ith channel sampled with the sample index k, d denotes a delay value that is a predetermined integer, and l denotes a length of a sampling interval, the residual signal encoding unit 130 may calculate the ICC parameter, denoted by $\Phi_{i,i+1}$, between the audio signals of the ith channel and the (i+1)th channel, using Equation 1 below:

[Equation 1]

$$\Phi_{i,i+1}(d) = \lim_{l\to\infty}\frac{\sum_{k=-l}^{l} x_i(k)x_{i+1}(k+d)}{\sqrt{\sum_{k=-l}^{l} x_i^2(k)\sum_{k=-l}^{l} x_{i+1}^2(k)}}$$

For example, if the input signals are 5.1-channel audio signals, and a left (L) channel, a surround left (Ls) channel, a center (C) channel, a subwoofer (Sw) channel, a right (R) channel and a surround right (Rs) channel are indexed from 1 to 6, respectively, the residual signal encoding unit 130 calculates at least one ICC parameter selected from among $\Phi_{1,2}$, $\Phi_{2,3}$, $\Phi_{3,4}$, $\Phi_{4,5}$, $\Phi_{5,6}$, and $\Phi_{1,6}$. As will be described later, such an ICC parameter may be used to determine weights for the first multi-channel audio signal $Ch_1$ and the second multi-channel audio signal $Ch_2$ (i.e., a combination ratio thereof) when generating a final restored audio signal by combining the first multi-channel audio signal $Ch_1$ restored on a decoding side and the second multi-channel audio signal $Ch_2$ having a predetermined phase difference with respect to the first multi-channel audio signal $Ch_1$.

In addition to the ICC parameter described above, the residual signal encoding unit 130 may further generate a center-channel correction parameter representing an energy ratio between an input audio signal of a center channel and a restored audio signal of the center channel, and an entire-channel correction parameter representing an energy ratio between input audio signals of all channels and restored audio signals of all the channels.

In particular, assuming that k denotes a sample index, $x_c(k)$ denotes a value of an input audio signal of a center channel sampled with a sample index k, $x'_c(k)$ denotes a value of a restored audio signal of the center channel sampled with the sample index k, l denotes the length of a sampling interval, the residual signal encoding unit 130 may generate a center-channel correction parameter (κ) using Equation 2 below:

$$\kappa = \sqrt{\frac{\sum_{k=-l}^{l} x_c^2(k)}{\sum_{k=-l}^{l} x_c^2(k)}} \quad \text{[Equation 2]}$$

Referring to Equation 2, the center-channel correction parameter (κ) represents an energy ratio between an input audio signal of the center channel and a restored audio signal of the center channel, and is used to correct the restored audio signal of the central channel on a decoding side, as will be described later. One reason to separately generate the center-channel correction parameter (κ) for correcting the audio signal of the center channel is to compensate for the deterioration of the audio signal of the center channel that may occur in parametric audio coding.

In addition, assuming that N is a positive integer denoting the number of input multi-channels, k denotes a sample index, $x_i(k)$ denotes a value of an input audio signal of an ith channel sampled with a sample index k, $x'_i(k)$ denotes a value of a restored audio signal of the ith channel sampled with the sample index k, and l denotes a length of a sampling interval, the residual signal encoding unit 130 may generate an entire-channel correction parameter (δ) by using Equation 3 below:

$$\delta = \sqrt{\frac{\sum_{i=1}^{N}\sum_{k=-l}^{l} x_i'^2(k)}{\sum_{i=1}^{N}\sum_{k=-l}^{l} x_i^2(k)}} \quad \text{[Equation 3]}$$

Referring to Equation 3, the entire-channel correction parameter (δ) represents an energy ratio between the input audio signals of all the channels and the restored audio signals of all the channels, and is used to correct the restored audio signals of all the channels on a decoding side, as will be described later.

Figure 6:
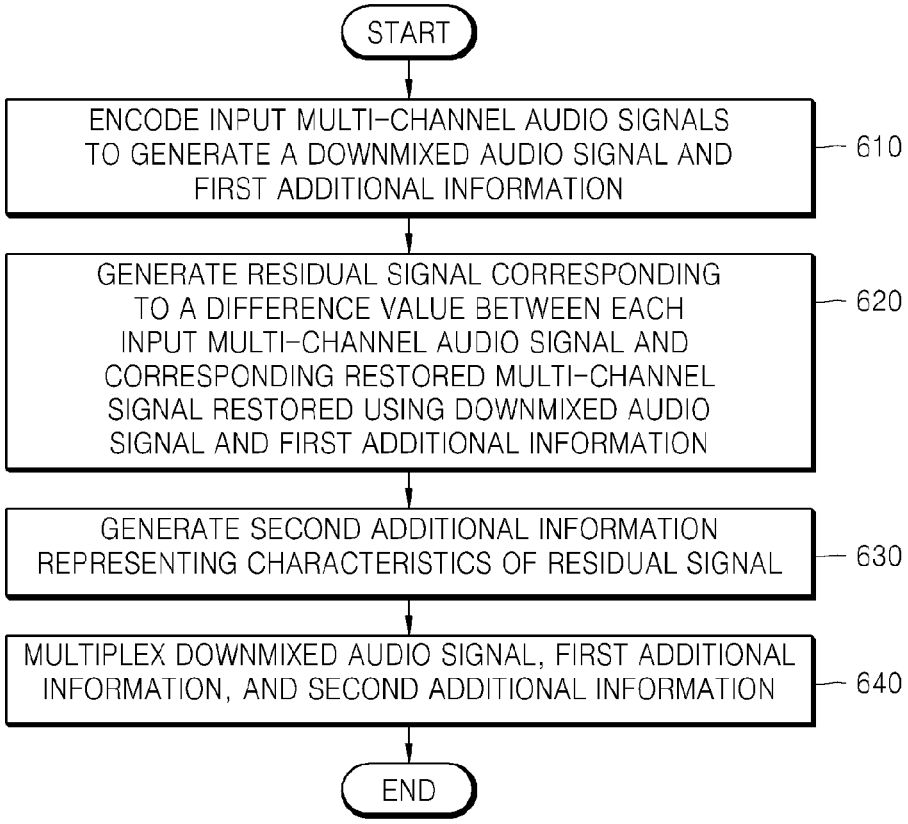
FIG. 6 is a flowchart of a method of encoding multi-channel audio signals, according to an exemplary embodiment of the present inventive concept.

FIG. 6 is a flowchart of a method of encoding multi-channel audio signals, according to an exemplary embodiment of the present inventive concept. Referring to FIG. 6, in operation 610, parametric encoding is performed on input multi-channel audio signals to generate a downmixed audio signal and first additional information for restoring the multi-channel audio signals from the downmixed audio signal. As described above, the multi-channel encoding unit 110 downmixes the input multi-channel audio signals into the downmixed audio signal, which may be stereophonic or monophonic, and generates the first additional information for restoring the multi-channel audio signals from the downmixed audio signal. The first additional information may include information for determining intensities of the audio signals to be downmixed and/or information about a phase difference between the audio signals to be downmixed.

In operation 620, a residual signal is generated, wherein the residual signal corresponds to a difference value between each of the input multi-channel audio signals and the corresponding restored multi-channel signal that is restored using the downmixed audio signal and the first additional information. As described above with reference to FIG. 5, a process of generating restored multi-channel audio signals may include generating two upmixed output signals by upmixing the downmixed audio signal, and recursively upmixing each of the upmixed output signals.

In operation 630, second additional information representing characteristics of the residual signal is generated. The second additional information is used to correct the restored multi-channel audio signals on a decoding side, and may include an ICC parameter representing a correlation between the input multi-channel audio signals of at least two different channels. Optionally, the second additional information may further include a center-channel correction parameter representing an energy ratio between an input audio signal of a center channel and a restored audio signal of the center channel, and an entire-channel correction parameter representing an energy ratio between the input audio signals of all channels and the restored audio signals of all the channels.

In operation 640, the downmixed audio signals, the first additional information, and the second additional information are multiplexed.

Figure 7:
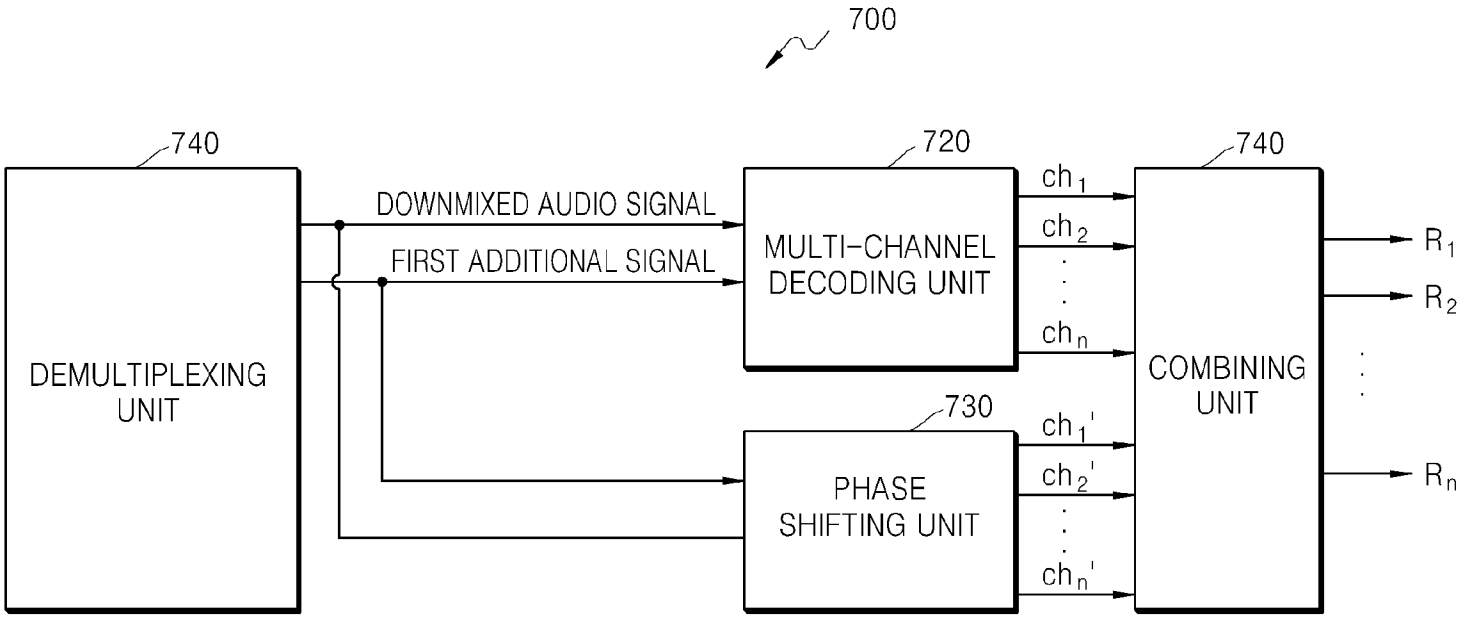
FIG. 7 is a block diagram of an apparatus which decodes multi-channel audio signals, according to an exemplary embodiment of the present inventive concept.

FIG. 7 is a block diagram of an apparatus 700 which decodes multi-channel audio signals, according to an exemplary embodiment of the present inventive concept. Referring to FIG. 7, the apparatus 700 which decodes multi-channel audio signals includes a demultiplexing unit 710, a multi-channel decoding unit 720, a phase shifting unit 730, and a combining unit 740.

The demultiplexing unit 710 parses the encoded audio bitstream to extract the downmixed audio signal, the first additional information for restoring the multi-channel audio signals from the downmixed audio signal, and the second additional information representing characteristics of the residual signals.

The multi-channel decoding unit 720 restores first multi-channel audio signals from the downmixed audio signal based on the first additional information. Similar to the restoring unit 510 of FIG. 1 described above, the multi-channel decoding unit 720 generates two upmixed output signals from the downmixed audio signal by using the first additional information, and repeatedly upmixes each of the upmixed output signals in order to restore the multi-channel audio signals from the downmixed audio signal. The restored multi-channel audio signals are defined as the first multi-channel audio signals.

Figure 8:
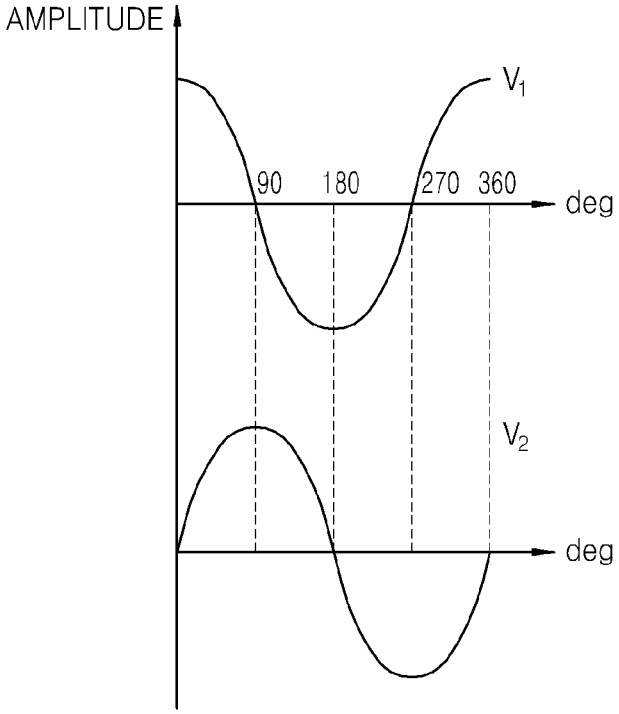
FIG. 8 is a graph of audio signals having a phase difference of 90 degrees.

The phase shifting unit 730 generates second multi-channel audio signals each of which has a predetermined phase difference with respect to the corresponding first multi-channel audio signal. In other words, the phase shifting unit 730 generates a phase-shifted second multi-channel audio signal to satisfy the relation of tn'=tn*exp(i*θd), where to denotes a first multi-channel audio signal of an nth channel of the multiple channels, tn' denotes a second multi-channel audio signal of the nth channel, and θd denotes a predetermined phase difference between the first and second multi-channel audio signals of the nth channel. For example, like signals V1 and V2 illustrated in FIG. 8, the first multi-channel audio signal and the second multi-channel audio signal of the nth channel may have a phase difference of 90 degrees.

One reason for generating the second multi-channel audio signal having a predetermined phase difference with respect to the first multi-channel audio signal is to compensate for a phase loss that occurs when encoding the multi-channel audio signals since the first multi-channel audio signal and the second multi-channel audio signals are combined. In the apparatus 100 which encodes multi-channel audio signals according to the exemplary embodiment of the present inventive concept described above with reference to FIG. 1, even though each pair of input audio signals that have been downmixed into an audio signal are restored through upmixing when downmixing the multi-channel audio signals, phases of the initial input audio signals are averaged, and thus a phase difference therebetween is lost. Furthermore, even though information about a phase difference between the two input audio signals is provided as the first additional information, a phase difference between multi-channel audio signals restored based on the first additional information differs from the initial phase difference between the input audio signals, thus hindering sound quality improvement of the decoded multi-channel audio signals.

The combining unit 740 combines the first multi-channel audio signal and the second multi-channel audio signal by using the second additional information to generate a final restored audio signal. In particular, the combining unit 740 multiplies the first and second multi-channel audio signals of each channel by predetermined weights, respectively. Then, the combining unit 740 combines the first and second multi-channel audio signals that are separately multiplied, to generate a combined audio signal of each channel. For example, assuming that $\alpha$ denotes a weight by which a first multi-channel audio signal (tn) of an nth channel is multiplied, and $\beta$ denotes a weight by which a second multi-channel audio signal (tn') of the nth channel is multiplied, a combined audio signal $u_n$ of the nth channel may be represented by the equation of $u_n=\alpha t_n+\beta t_n'$.

The combining unit 740 calculates the predetermined weights by using a relationship between the ICC parameter, included in the second additional information, representing a correlation between the input multi-channel audio signals of two different channels, and a correlation between combined audio signals of the two different channels. Assuming that N is a positive integer denoting the number of input multi-channels, $\Phi_{i,i+1}$ denotes an ICC parameter representing a correlation between audio signals of an ith channel and an (i+1)th channel, where i is an integer from 1 to N−1, k denotes a sample index, $x_i(k)$ denotes a value of an input audio signal of the ith channel sampled with a sample index k, d denotes a delay value that is a predetermined integer, and l denotes a length of a sampling interval, weights $\alpha$ and $\beta$ satisfying Equation 4 below are calculated:

$$\sqrt{\alpha^2+\beta^2}=1, \text{ and} \qquad \text{[Equation 4]}$$

$$\Phi_{n,n+1}(d)=\lim_{l\to\infty}\frac{\sum_{k=-l}^{l}u_n(k)u_{n+1}(k+d)}{\sqrt{\sum_{k=-l}^{l}u_n^2(k)\sum_{k=-l}^{l}u_{n+1}^2(k)}}=$$

-continued $$\lim_{l\to\infty}\frac{\sum_{k=-l}^{l}x_n(k)x_{n+1}(k+d)}{\sqrt{\sum_{k=-l}^{l}x_n^2(k)\sum_{k=-l}^{l}x_{n+1}^2(k)}}$$

After weights $\alpha$ and $\beta$ are calculated using Equation 4, the combining unit 740 determines the combined audio signal of the nth channel, calculated using $u_n=\alpha t_n+\beta t_n'$, as a final restored audio signal of the nth channel. The combining unit 740 recursively performs the above-described operation on all the channels to generate final restored audio signals of all the channels.

After the final restored audio signals are generated using the ICC parameter, as described above, the combining unit 740 may correct the final restored audio signals by using the center-channel correction parameter, which represents the energy ratio between the input audio signal of the center channel and the restored audio signal of the center channel, and the entire-channel correction parameter, which represents the energy ratio between the input audio signals of all the channels and the restored audio signals of all the channels.

In particular, the combining unit 740 corrects the final restored audio signals of all the channels by using the entire-channel correction parameter ($\delta$). For example, the combining unit 740 corrects a final restored audio signal $u_n$ of an nth channel by multiplying the final restored audio signal $u_n$ of the nth channel by the entire-channel correction parameter ($\delta$). This process is recursively performed on all the channels. In addition, the combining unit 740 may correct the final restored audio signal of the center channel by multiplying the final restored audio signal by the entire-channel correction parameter ($\delta$) and the center-channel correction parameter ($\kappa$).

As described above, the apparatus 700 which decodes multi-channel audio signals may improve quality of restored multi-channel audio signals by combining the first multi-channel audio signal and the second multi-channel audio signal having a phase difference by using an ICC parameter, and by correcting all the channel audio signals and the center-channel audio signal by using the entire-channel correction parameter ($\delta$) and the center-channel correction parameter ($\kappa$).

Figure 9:
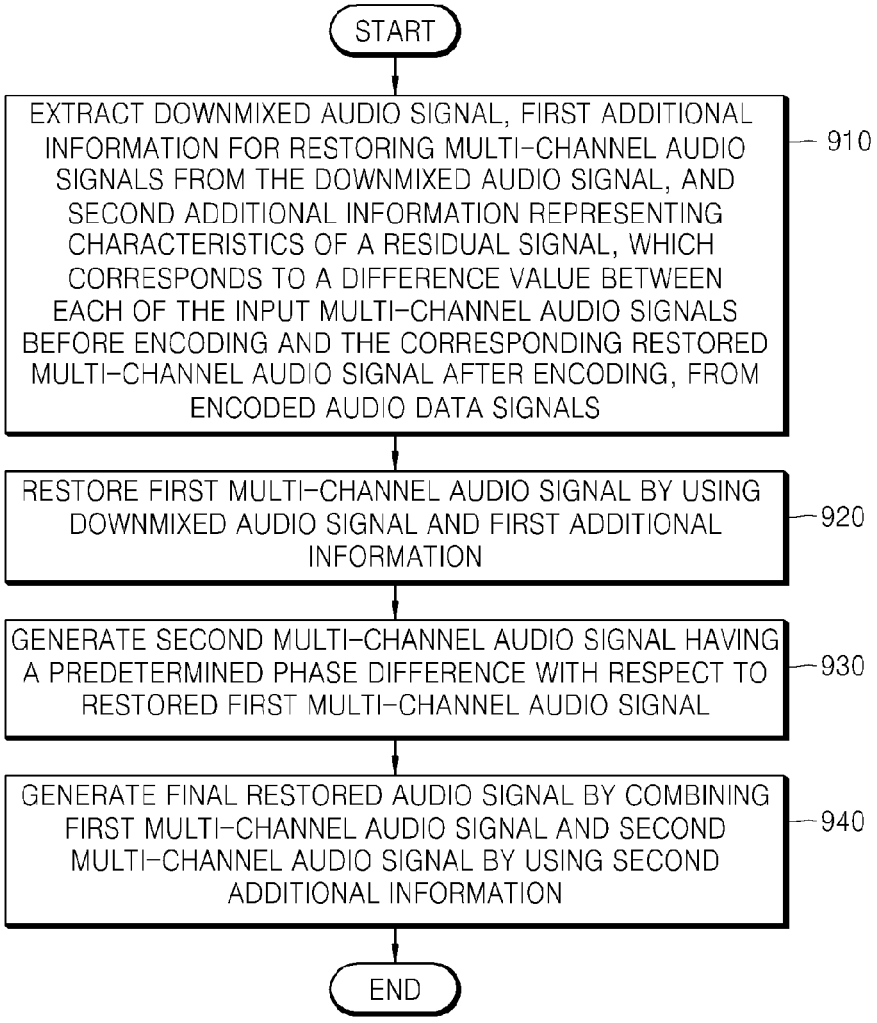
FIG. 9 is a flowchart of a method of decoding multi-channel audio signals, according to another exemplary embodiment of the present inventive concept.

FIG. 9 is a flowchart of a method of decoding multi-channel audio signals, according to another exemplary embodiment of the present inventive concept. Referring to FIG. 9, in operation 910, the downmixed audio signal, the first additional information for restoring multi-channel audio signals from the downmixed audio signal, and the second additional information representing characteristics of a residual signal are extracted from encoded audio data signals. As described above, the residual signal corresponds to a difference value between each of the input multi-channel audio signals before encoding and the corresponding restored multi-channel audio signal after encoding.

In operation 920, a first multi-channel audio signal is restored using the downmixed audio signal and the first additional information. As described above, a first multi-channel audio signal is restored by generating two upmixed output signals from the downmixed audio signal by using the first additional information, and repeatedly upmixing each of the upmixed output signals.

In operation 930, a second multi-channel audio signal having a predetermined phase difference with respect to the restored first multi-channel audio signal is generated. The predetermined phase difference may be 90 degrees.

In operation 940, a final restored audio signal is generated by combining the first multi-channel audio signal and the second multi-channel audio signal by using the second additional information. In particular, the combining unit 740 calculates weights by which the first multi-channel audio signal and the second multi-channel audio signal are respectively to be multiplied, using a relationship between an ICC parameter, included in the second additional information and representing a correlation between the input multi-channel audio signals of two different channels, and a correlation between combined audio signals of the two different channels. The combining unit 740 generates the final restored audio signal by calculating a weighted sum of the first multi-channel audio signal and the second multi-channel audio signal by using the calculated weights. Optionally, the combining unit 740 may correct the restored audio signals of all the channels and the restored audio signal of the center channel by using the entire-channel correction parameter ($\delta$) and the center-channel correction parameter ($\kappa$), in order to improve sound quality of the restored multi-channel audio signals.

According to aspects of the present general inventive concept, a least amount of residual signal information is efficiently encoded when encoding multi-channel audio signals, and the encoded multi-channel audio signals are decoded using residual signals, thus improving sound quality of the audio signal of each channel.

The exemplary embodiments of the present inventive concept can be written as computer programs and can be implemented in general-use digital computers that execute the programs by using a computer readable recording medium. Examples of the computer readable recording medium include magnetic storage media (e.g., ROM, floppy disks, hard disks, etc.), and optical recording media (e.g., CD-ROMs, or DVDs). Moreover, while not required in all aspects, one or more units of the apparatus 100 which encodes multi-channel audio signals and/or the apparatus 700 which decodes mutli-channel audio signals can include a processor or microprocessor executing a computer program stored in a computer-readable medium. Also, the exemplary embodiments of the present inventive concept can be written as computer programs transmitted over a computer-readable transmission medium, such as a carrier wave, and received and implemented in general-use digital computers that execute the programs.

While this inventive concept has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the inventive concept but by the appended claims, and all differences within the scope will be construed as being included in the present invention.

What is claimed is:

1. A method of encoding multi-channel audio signals, the method comprising:

performing parametric encoding on input multi-channel audio signals to generate a downmixed audio signal and first additional information;

restoring the multi-channel audio signals from the downmixed audio signal using the downmixed audio signal and the first additional information;

generating a residual signal corresponding to a difference value between each of the input multi-channel audio signals and the corresponding restored multi-channel audio signal;

generating second additional information representing characteristics of the residual signal; and multiplexing the downmixed audio signal, the first additional information, and the second additional information, wherein the second additional information comprises an interchannel correlation (ICC) parameter representing a correlation between the input multi-channel audio signals of two different channels, and wherein the residual signal is not multiplexed with the downmixed audio signal, the first additional information, and the second additional information.

2. The method of claim 1, wherein the performing of the parametric encoding on the input multi-channel audio signals comprises:

downmixing the input multi-channel audio signals by combining input multi-channel audio signals of each pair of channels to generate downmixed output signals; and recursively performing the downmixing on each pair of the downmixed output signals to generate the downmixed audio signal.

3. The method of claim 2, wherein the first additional information comprises information for determining intensities of the audio signals to be downmixed and information on phase differences between the audio signals to be downmixed.

4. The method of claim 3, wherein:

the information for determining the intensities of the audio signal to be downmixed comprises information on a magnitude of a third vector that is a sum of a first vector and a second vector in a vector space having a predetermined angle between the first vector and the second vector, and information about an angle between the third vector and one of the first vector and the second vector in the vector space; and the first vector corresponds to an intensity of a first signal of the two input multi-channel audio signals to be downmixed, and the second vector corresponds to an intensity of a second signal of the two input multi-channel audio signals to be downmixed.

5. The method of claim 3, wherein:

the downmixing of the input multi-channel audio signals comprises adjusting a phase of a second channel input audio signal to be equal to a phase of a first channel input audio signal, the first and second channel input audio signals being of a pair of channels from among the input multi-channel audio signals; and the information on the phase differences is information on a phase difference between the first channel input audio signal and the second channel input audio signal.

6. The method of claim 1, wherein:

the restoring of the multi-channel audio signals comprises:

generating two upmixed output signals from the downmixed audio signal by using the first additional information and repeatedly upmixing each of the generated upmixed output signals to restore the multi-channel audio signals; and the generating of the residual signal comprises:

calculating the difference value between each of the input multi-channel audio signals and the corresponding restored multi-channel audio signal to generate the residual signal of each channel.

7. The method of claim 6, wherein:

the first additional information comprises information on a magnitude of a third vector corresponding to an intensity of the downmixed audio signal, the third vector being a sum of a first vector and a second vector in a vector space having a predetermined angle between the first vector and the second vector, and information on an angle between the third vector and one of the first vector and the second vector in the vector space;

the first vector corresponds to an intensity of a first signal of the two upmixed output signals, and the second vector corresponds to an intensity of a second signal of the two upmixed output signals; and the generating of the two upmixed output signals comprises generating the two upmixed output signals respectively corresponding to the first vector and the second vector from the downmixed audio signal by using the information on the magnitude of the third vector corresponding to the intensity of the downmixed audio signal and the information on the angle between the third vector and the one of the first vector and the second vector in the vector space.

8. The method of claim 1, wherein the ICC parameter $\Phi_{i,i+1}$ representing the correlation between the input audio signals of an ith channel and an (i+1)th channel is calculated according to:

$$\Phi_{i,i+1}(d) = \lim_{l\to\infty} \frac{\sum_{k=-l}^{l} x_i(k)x_{i+1}(k+d)}{\sqrt{\sum_{k=-l}^{l} x_i^2(k) \sum_{k=-l}^{l} x_{i+1}^2(k)}},$$

where N is a positive integer denoting a number of input multi-channels, $\Phi_{i,i+1}$ denotes the ICC parameter representing the correlation between the input audio signals of the ith channel and the (i+1)th channel, i is an integer from 1 to N−1, k denotes a sample index, $x_i(k)$ denotes a value of the input audio signal of the ith channel sampled with the sample index k, d denotes a delay value that is a predetermined integer, and l denotes a length of a sampling interval.

9. The method of claim 1, wherein the second additional information comprises:

a center-channel correction parameter representing an energy ratio between an input audio signal of a center channel and a restored audio signal of the center channel; and an entire-channel correction parameter representing an energy ratio between input audio signals of all channels and restored audio signals of all the channels.

10. The method of claim 9, wherein the center-channel correction parameter (κ) is calculated according to:

$$\kappa = \sqrt{\frac{\sum_{k=-l}^{l} x_c'^2(k)}{\sum_{k=-l}^{l} x_c^2(k)}},$$

where k denotes a sample index, $x_c(k)$ denotes a value of the input audio signal of the center channel sampled with the sample index k, $x'_c(k)$ denotes a value of the restored audio signal of the center channel sampled with the sample index k, and l denotes a length of a sampling interval.

11. The method of claim 9, wherein the entire-channel correction parameter (δ) is calculated according to:

$$\delta = \sqrt{\frac{\sum_{i=1}^{N} \sum_{k=-l}^{l} x_i'^2(k)}{\sum_{i=1}^{N} \sum_{k=-l}^{l} x_i^2(k)}},$$

where N is a positive integer denoting a number of input multi-channels, k denotes a sample index, $x_i(k)$ denotes a value of an input audio signal of an ith channel sampled with the sample index k, $x'_i(k)$ denotes a value of a restored audio signal of the ith channel sampled with the sample index k, and l denotes a length of a sampling interval.

12. An apparatus for encoding multi-channel audio signals, the apparatus comprising:

a multi-channel encoding unit which performs parametric encoding on input multi-channel audio signals to generate a downmixed audio signal and first additional information used to restore the multi-channel audio signals from the downmixed audio signal;

a residual signal generating unit which restores the multi-channel audio signals from the downmixed audio signal using the downmixed audio signal and the first additional information, and which generates a residual signal corresponding to a difference value between each of the input multi-channel audio signals and the corresponding restored multi-channel audio signal;

a residual signal encoding unit which generates second additional information representing characteristics of the residual signal; and a multiplexing unit which multiplexes the downmixed audio signal, the first additional information, and the second additional information, wherein the second additional information comprises an interchannel correlation (ICC) parameter representing a correlation between the input multi-channel audio signals of two different channels, and wherein the residual signal is not multiplexed with the downmixed audio signal, the first additional information, and the second additional information.

13. The apparatus of claim 12, wherein:

the multi-channel encoding unit combines input multi-channel audio signals of each pair of channels to generate downmixed output signals and recursively performs the downmixing on each pair of the downmixed output signals to generate the downmixed audio signal; and the first additional information comprises information for determining intensities of the audio signals to be downmixed and information on phase differences between the audio signals to be downmixed.

14. The apparatus of claim 13, wherein:

the information for determining the intensities of the audio signals to be downmixed comprises information on a magnitude of a third vector that is a sum of a first vector and a second vector in a vector space having a predetermined angle between the first vector and the second vector, and information about an angle between the third vector and one of the first vector and the second vector in the vector space; and the first vector corresponds to an intensity of a first signal of the two input multi-channel audio signals to be downmixed, and the second vector corresponds to an intensity of a second signal of the two input multi-channel audio signals to be downmixed.

15. The apparatus of claim 13, wherein:

the multi-channel encoding unit combines the input multi-channel audio signals of each pair of channels by adjusting a phase of a second channel input audio signal to be equal to a phase of a first channel input audio signal, the first and second channel input audio signals being of a pair of channels from among the input multi-channel audio signals; and the information on the phase differences is information on a phase difference between the first channel input audio signal and the second channel input audio signal.

16. The apparatus of claim 12, wherein the ICC parameter $\Phi_{i,i+1}$ representing the correlation between the input audio signals of an ith channel and an (i+1)th channel is calculated according to:

$$\Phi_{i,i+1}(d) = \lim_{l\to\infty} \frac{\sum_{k=-l}^{l} x_i(k)x_{i+1}(k+d)}{\sqrt{\sum_{k=-l}^{l} x_i^2(k) \sum_{k=-l}^{l} x_{i+1}^2(k)}},$$

where N is a positive integer denoting a number of input multi-channels, $\Phi_{i,i+1}$ denotes the ICC parameter representing the correlation between the input audio signals of the ith channel and the (i+1)th channel, i is an integer from 1 to N−1, k denotes a sample index, $x_i(k)$ denotes a value of the input audio signal of the ith channel sampled with the sample index k, d denotes a delay value that is a predetermined integer, and l denotes a length of a sampling interval.

17. The apparatus of claim 12, wherein the second additional information further comprises:

a center-channel correction parameter representing an energy ratio between an input audio signal of a center channel and a restored audio signal of the center channel; and an entire-channel correction parameter representing an energy ratio between input audio signals of all channels and restored audio signals of all the channels.

18. The apparatus of claim 17, wherein the center-channel correction parameter (κ) is calculated according to:

$$\kappa = \sqrt{\frac{\sum_{k=-l}^{l} x_c'^2(k)}{\sum_{k=-l}^{l} x_c^2(k)}},$$

where k denotes a sample index, $x_c(k)$ denotes a value of the input audio signal of the center channel sampled with the sample index k, $x'_c(k)$ denotes a value of the restored audio signal of the center channel sampled with the sample index k, and l denotes a length of a sampling interval.

19. The apparatus of claim 17, wherein the entire-channel correction parameter (δ) is calculated according to:

$$\delta = \sqrt{\frac{\sum_{i=1}^{N} \sum_{k=-l}^{l} x_i'^2(k)}{\sum_{i=1}^{N} \sum_{k=-l}^{l} x_i^2(k)}},$$

where N is a positive integer denoting a number of input multi-channels, k denotes a sample index, $x_i(k)$ denotes a value of an input audio signal of an ith channel sampled with the sample index k, $x'_i(k)$ denotes a value of a restored audio signal of the ith channel sampled with the sample index k, and l denotes a length of a sampling interval.

20. A method of decoding multi-channel audio signals, the method comprising:

extracting, from encoded audio data, a downmixed audio signal, first additional information used to restore multi-channel audio signals from the downmixed audio signal, and second additional information representing characteristics of a residual signal, which corresponds to a difference value between each of input multi-channel audio signals before encoding to the downmixed audio signal and the corresponding restored multi-channel audio signal after the encoding;

restoring a first multi-channel audio signal by using the downmixed audio signal and the first additional information;

generating a second multi-channel audio signal having a predetermined phase difference with respect to the restored first multi-channel audio signal by using the downmixed audio signal and the first additional information; and generating a final restored audio signal by combining the restored first multi-channel audio signal and the generated second multi-channel audio signal by using the second additional information.

21. The method of claim 20, wherein the restoring of the first multi-channel audio signal comprises:

generating two upmixed output signals from the downmixed audio signal by using the first additional information and the downmixed audio signal; and recursively upmixing each of the upmixed output signals to restore the first multi-channel audio signal.

22. The method of claim 21, wherein:

the first additional information comprises information on a magnitude of a third vector corresponding to an intensity of the downmixed audio signal, the third vector being a sum of a first vector and a second vector in a vector space having a predetermined angle between the first vector and the second vector, and information on an angle between the third vector and one of the first vector and the second vector in the vector space;

the first vector corresponds to an intensity of a first signal of the two upmixed output signals, and the second vector corresponds to an intensity of a second signal of the two upmixed output signals; and the generating two upmixed output signals comprises generating the two upmixed output signals respectively corresponding to the first vector and the second vector from the downmixed audio signal by using the information on the magnitude of the third vector corresponding to the intensity of the downmixed audio signal and the information on the angle between the third vector and the one of the first vector and the second vector in the vector space.

23. The method of claim 21, wherein:

the first additional information comprises information on a phase difference between the two upmixed output signals; and the generating of the two upmixed output signals comprises adjusting a phase of one of the two upmixed output signals by the phase difference, wherein an other of the two upmixed output signals is equal to a phase of the downmixed audio signal.

24. The method of claim 20, wherein the first multi-channel audio signal and the second multi-channel audio signal have a phase difference of 90 degrees.

25. The method of claim 20, wherein:

the second additional information comprises an interchannel correlation (ICC) parameter representing a correlation between the input multi-channel audio signals of two different channels; and the generating of the final restored audio signal comprises:

calculating predetermined weights by using a relationship between the ICC parameter and a correlation between combined audio signals of the two different channels, and multiplying the first and second multi-channel audio signals of each channel by the calculated predetermined weights, respectively, and combining the first and second multi-channel audio signals that are separately multiplied to generate the final restored audio signal of each channel.

26. The method of claim 25, wherein a combined audio signal $u_n$ of an nth channel is $u_n=\alpha t_n+\beta t_n'$, and the predetermined weights $\alpha$ and $\beta$ are calculated according to:

$$\alpha^2+\beta^2=1, \text{ and}$$

$$\Phi_{n,n+1}(d)=\lim_{l\to\infty}\frac{\sum_{k=-l}^{l}u_n(k)u_{n+1}(k+d)}{\sqrt{\sum_{k=-l}^{l}u_n^2(k)\sum_{k=-l}^{l}u_{n+1}^2(k)}}=\lim_{l\to\infty}\frac{\sum_{k=-l}^{l}x_n(k)x_{n+1}(k+d)}{\sqrt{\sum_{k=-l}^{l}x_n^2(k)\sum_{k=-l}^{l}x_{n+1}^2(k)}},$$

where N is a positive integer denoting a number of input multi-channels, $\Phi_{i,i+1}$ denotes an ICC parameter representing a correlation between audio signals of an ith channel and a (i+1)th channel, i is an integer from 1 to N−1, k denotes a sample index, $x_i(k)$ denotes a value of an input audio signal of the ith channel sampled with the sample index k, d denotes a delay value that is a predetermined integer, l denotes a length of a sampling interval, $t_n$ denotes the first multi-channel audio signal of an nth channel, $t_n'$ denotes the second multi-channel audio signal of the nth channel, $\alpha$ denotes the predetermined weight by which the first multi-channel audio signal is multiplied, and $\beta$ denotes the predetermined weight by which the second multi-channel audio signal is multiplied.

27. The method of claim 25, wherein:

the second additional information further comprises:

a center-channel correction parameter ($\kappa$) representing an energy ratio between an input audio signal of a center channel and a restored audio signal of the center channel, and an entire-channel correction parameter ($\delta$) representing an energy ratio between input audio signals of all channels and restored audio signals of all the channels; and the generating of the final restored audio signal further comprises:

correcting the final restored audio signals of all the channels by using the entire-channel correction parameter ($\delta$), and further correcting the final restored audio signal of the center channel, among the final restored audio signals of all the channels, using the center-channel correction parameter ($\kappa$).

28. The method of claim 27, wherein the center-channel correction parameter ($\kappa$) is calculated according to:

$$\kappa=\sqrt{\frac{\sum_{k=-l}^{l}x_c'^2(k)}{\sum_{k=-l}^{l}x_c^2(k)}},$$

where k denotes a sample index, $x_c(k)$ denotes a value of the input audio signal of the center channel sampled with the sample index k, $x'_c(k)$ denotes a value of the restored audio signal of the center channel sampled with the sample index k, l denotes the length of a sampling interval.

29. The method of claim 27, wherein the entire-channel correction parameter ($\delta$) is calculated according to:

$$\delta=\sqrt{\frac{\sum_{i=1}^{N}\sum_{k=-l}^{l}x_i'^2(k)}{\sum_{i=1}^{N}\sum_{k=-l}^{l}x_i^2(k)}},$$

where N is a positive integer denoting a number of input multi-channels, k denotes a sample index, $x_i(k)$ denotes a value of an input audio signal of an ith channel sampled with the sample index k, $x'_i(k)$ denotes a value of a restored audio signal of the ith channel sampled with the sample index k, and l denotes a length of a sampling interval.

30. An apparatus for decoding multi-channel audio signals, the apparatus comprising:

a demultiplxing unit which extracts, from encoded audio data, a downmixed audio signal, first additional information used to restore multi-channel audio signals from the downmixed audio signal, and second additional information representing characteristics of a residual signal, which corresponds to a difference value between each of input multi-channel audio signals before encoding to the downmixed audio signal and the corresponding restored multi-channel audio signal after the encoding;

a multi-channel decoding unit which restores a first multi-channel audio signal by using the downmixed audio signal and the first additional information;

a phase shifting unit which generates a second multi-channel audio signal having a predetermined phase difference with respect to the restored first multi-channel audio signal by using the downmixed audio signal and the first additional information; and a combining unit which combines the restored first multi-channel audio signal and the generated second multi-channel audio signal by using the second additional information to generate a final restored audio signal.

31. The apparatus of claim 30, wherein the multi-channel decoding unit generates two upmixed output signals from the downmixed audio signal by using the first additional information and the downmixed audio signal and repeatedly upmixing each of the upmixed output signals to restore the first multi-channel audio signals.

32. The apparatus of claim 31, wherein:

the first additional information comprises information on a magnitude of a third vector corresponding to an intensity of the downmixed audio signal, the third vector being a sum of a first vector and a second vector in a vector space having a predetermined angle between the first vector and the second vector, and information about an angle between the third vector and one of the first vector and the second vector in the vector space;

the first vector corresponds to an intensity of a first signal of the two upmixed output signals, and the second vector corresponds to an intensity of a second signal of the two upmixed output signals; and the multi-channel decoding unit generates the two upmixed output signals respectively corresponding to the first vector and the second vector from the downmixed audio signal by using the information on the magnitude of the third vector corresponding to the intensity of the downmixed audio signal and the information on the angle between the third vector and one of the first vector and the second vector in the vector space.

33. The apparatus of claim 31, wherein:

the first additional information comprises information on a phase difference between the two upmixed output signals; and the multi-channel decoding unit generates the two upmixed output signals by adjusting a phase of one of the two upmixed output signals by the phase difference, wherein an other of the two upmixed output signals is equal to a phase of the downmixed audio signal.

34. The apparatus of claim 30, wherein the first multi-channel audio signal and the second multi-channel audio signal have a phase difference of 90 degrees.

35. The apparatus of claim 30, wherein:

the second additional information comprises an interchannel correlation (ICC) parameter representing a correlation between the input multi-channel audio signals of two different channels; and the combining unit calculates predetermined weights by using a relationship between the ICC parameter and a correlation between combined audio signals of the two different channels, and generates a combined audio signal of each channel as the final restored audio signal thereof by multiplying the first multi-channel audio signal and the second multi-channel audio signal by the calculated predetermined weights, respectively, and combining the multiplied first and second multi-channel audio signals.

36. The apparatus of claim 35, wherein a combined audio signal $u_n$ of an nth channel is $u_n=\alpha t_n+\beta t_n'$, and the predetermined weights $\alpha$ and $\beta$ are calculated according to:

$$\alpha^2+\beta^2=1, \text{ and}$$

$$\Phi_{n,n+1}(d)=\lim_{l\to\infty}\frac{\sum_{k=-l}^{l}u_n(k)u_{n+1}(k+d)}{\sqrt{\sum_{k=-l}^{l}u_n^2(k)\sum_{k=-l}^{l}u_{n+1}^2(k)}}=\lim_{l\to\infty}\frac{\sum_{k=-l}^{l}x_n(k)x_{n+1}(k+d)}{\sqrt{\sum_{k=-l}^{l}x_n^2(k)\sum_{k=-l}^{l}x_{n+1}^2(k)}},$$

where N is a positive integer denoting a number of input multi-channels, $\Phi_{i,i+1}$ denotes an ICC parameter representing a correlation between audio signals of an ith channel and a (i+1)th channel, i is an integer from 1 to N−1, k denotes a sample index, $x_i(k)$ denotes a value of an input audio signal of the ith channel sampled with the sample index k, d denotes a delay value that is a predetermined integer, l denotes a length of a sampling interval, $t_n$ denotes the first multi-channel audio signal of an nth channel, $t_n'$ denotes the second multi-channel audio signal of the nth channel, $\alpha$ denotes the predetermined weight by which the first multi-channel audio signal is multiplied, and $\beta$ denotes the predetermined weight by which the second multi-channel audio signal is multiplied.

37. The apparatus of claim 36, wherein:

the second additional information further comprises:

a center-channel correction parameter ($\kappa$) representing an energy ratio between an input audio signal of a center channel and a restored audio signal of the center channel, and an entire-channel correction parameter ($\delta$) representing an energy ratio between input audio signals of all channels and restored audio signals of all the channels; and the combining unit corrects the final restored audio signals of all the channels by using the entire-channel correction parameter ($\delta$) and further corrects the final restored audio signal of the center channel, among the final restored audio signals of all the channels, using the center-channel correction parameter ($\kappa$).

38. The apparatus of claim 37, wherein the center-channel correction parameter ($\kappa$) is calculated according to:

$$\kappa=\sqrt{\frac{\sum_{k=-l}^{l}x_c'^2(k)}{\sum_{k=-l}^{l}x_c^2(k)}},$$

where k denotes a sample index, $x_c(k)$ denotes a value of the input audio signal of the center channel sampled with the sample index k, $x'_c(k)$ denotes a value of the restored audio signal of the center channel sampled with the sample index k, l denotes the length of a sampling interval.

39. The apparatus of claim 37, wherein the entire-channel correction parameter (δ) is calculated using according to:

$$\delta = \sqrt{\frac{\sum_{i=1}^{N}\sum_{k=-l}^{l} x_i'^2(k)}{\sum_{i=1}^{N}\sum_{k=-l}^{l} x_i^2(k)}},$$

where N is a positive integer denoting a number of input multi-channels, k denotes a sample index, $x_i(k)$ denotes a value of an input audio signal of an ith channel sampled with the sample index k, $x'_i(k)$ denotes a value of a restored audio signal of the ith channel sampled with the sample index k, and l denotes a length of a sampling interval.

40. A method of encoding multi-channel audio signals, the method comprising:

performing parametric encoding on input multi-channel audio signals to generate a downmixed audio signal;

restoring the multi-channel audio signals from the downmixed audio signal;

generating a residual signal corresponding to a difference value between each of the input multi-channel audio signals and the corresponding restored multi-channel audio signal;

generating additional information representing characteristics of the residual signal; and multiplexing the downmixed audio signal and the additional information, wherein the additional information comprises an interchannel correlation (ICC) parameter representing a correlation between the input multi-channel audio signals of two different channels, and wherein the residual signal is not multiplexed with the downmixed audio signal and the additional information.

41. The method of claim 40, wherein the additional information comprises:

a center-channel correction parameter representing an energy ratio between an input audio signal of a center channel and a restored audio signal of the center channel; and an entire-channel correction parameter representing an energy ratio between input audio signals of all channels and restored audio signals of all the channels.

42. A method of generating final restored multi-channel audio signals from a downmixed audio signal, the method comprising:

extracting, from encoded audio data, the downmixed audio signal and additional information representing characteristics of a residual signal, which corresponds to a difference value between each of input multi-channel audio signals before encoding to the downmixed audio signal and the corresponding restored multi-channel audio signal after the encoding;

restoring a first multi-channel audio signals from the downmixed audio signal;

generating a second multi-channel audio signal having a predetermined phase difference with respect to the first multi-channel audio signal; and generating the final restored multi-channel audio signals by combining the first multi-channel audio signal and the second multi-channel audio signal by using the additional information.

43. The method of claim 42, wherein:

the additional information comprises an interchannel correlation (ICC) parameter representing a correlation between the input multi-channel audio signals of two different channels;

the generating of the final restored multi-channel audio signals comprises:

calculating predetermined weights by using a relationship between the ICC parameter and a correlation between combined audio signals of the two different channels, and multiplying the first and the second multi-channel audio signals of each channel by the calculated predetermined weights, respectively, and combining the first and second multi-channel audio signals that are separately multiplied to generate the final restored audio signal of each channel.

44. The method of claim 43, wherein:

the additional information further comprises:

a center-channel correction parameter (κ) representing an energy ratio between an input audio signal of a center channel and a restored audio signal of the center channel, and an entire-channel correction parameter (δ) representing an energy ratio between input audio signals of all channels and restored audio signals of all the channels, and the generating of the final restored multi-channel audio signals further comprises:

correcting the final restored multi-channel audio signals of all the channels by using the entire-channel correction parameter (δ), and further correcting the final restored multi-channel audio signal of the center channel, among the final restored multi-channel audio signals of all the channels, using the center-channel correction parameter (κ).

45. A non-transitory computer-readable recording medium encoded with the method of claim 1 and implemented by at least one computer.

46. A non-transitory computer-readable recording medium encoded with the method of claim 20 and implemented by at least one computer.

* * * * *